US005579935A

United States Patent [19]

Atkin et al.

[11] Patent Number: 5,579,935

[45] Date of Patent: Dec. 3, 1996

[54] DISPOSABLE BABY BOTTLE

[75] Inventors: Edward Atkin, London; Roger L. Williams, Hertfordshire, both of United Kingdom

[73] Assignee: Cannon Rubber Limited, United Kingdom

[21] Appl. No.: 347,519

[22] Filed: Nov. 30, 1994

[30] Foreign Application Priority Data

Jun. 30, 1994 [GB] United Kingdom ..... 9413129

[51] Int. Cl.[6] ..... A61J 9/00

[52] U.S. Cl. ..... 215/11.1; 220/281; 220/792

[58] Field of Search ..... 215/11.1, 11.3; 222/105, 390; 220/307, 281, 326, 346, 347

[56] References Cited

U.S. PATENT DOCUMENTS

| | | | |
|---|---|---|---|
| 3,325,063 | 6/1967 | Hansen | 222/390 |
| 3,517,851 | 6/1970 | Koller | 220/281 X |
| 3,651,973 | 3/1972 | Yamauchi | 215/11 B |
| 3,955,698 | 5/1976 | Hammer . | |
| 4,706,827 | 11/1987 | Cabernock et al. | 215/11.3 |
| 4,821,896 | 4/1989 | Cheng | 215/11.3 |
| 5,033,631 | 7/1991 | Nightengale | 215/11.3 X |
| 5,301,825 | 4/1994 | Di Scala et al. | 215/11.3 X |
| 5,356,016 | 10/1994 | Wiedemann | 215/11.3 |

*Primary Examiner*—Gary E. Elkins
*Assistant Examiner*—Christopher T. McDonald
*Attorney, Agent, or Firm*—Dilworth & Barrese

[57] ABSTRACT

A baby feeding bottle of the disposable bag liner type comprising a hollow open ended rigid tubular body (1) to receive a bag (2) having an open top end which can be folded over the top rim of the tubular body. A feeding teat (7) having an outwardly extending annular flange engages and rests on the portion of the bag (2) folded over the top rim of the tubular body (1). A teat retaining ring (3) is fitted to the tubular body (1) to retain the teat (7) and the folded over bag portion (2) thereon in sealing engagement therewith and a removable base (5) is mounted in the open bottom end of the rigid tubular body (1). A removable base (5) is mounted in the tubular body (1) by means (14,17) which allow the base (5) to be fixedly mounted in the tubular body (1) in a plurality of different positions along the length thereof whereby the base is not movable from its selected position when an axial pressure is applied thereto. The base (5) contacts and supports the bottom of a filled bag (2) when in any one of said selected positions.

4 Claims, 2 Drawing Sheets

DISPOSABLE BABY BOTTLE

This invention relates to an improved baby feeding bottle of the disposable bag liner type. Disposable bag liner baby feeding bottles generally comprise a hollow open ended rigid tubular body which receives a feed containing bag having one open end which is folded over the top rim of the tubular body and retained thereon by the outwardly extending annular flange of a teat which engages and rests on the portion of the bag folded over the top rim of the body, the teat and folded over bag portion being retained on the body in sealing engagement therewith by means of a teat retaining ring screwed thereon.

Baby feeding bottles of this type are well known. To use them, an empty open topped bag is inserted in the rigid tubular body and the top end of the bag is folded over the upper rim of the body. The user then grips the folded over portion of the bag around the upper region of the tubular body, fills the bag with water and adds the required amount of powder to make up the feed. Alternatively, the feed can be premixed in a separate container by the user and poured into the bag or made up from a purchased pre-mix. The user then screws the retaining ring with the teat already fitted therein on the top of the open end of the tubular body to retain the teat and bag in position thereon and shakes the whole assembly to mix the powder with the water in the bag.

There is however a problem in doing this because the end of the water filled bag remote from the teat is not supported in any way so it is free to move about in the rigid tubular body. This can be stressful for the person mixing the feed due to the worry that the bag may rupture or split or become separated from the rigid tubular body and spill the contents. A further problem with bottles of this type is that they are often designed for use with bags of different capacities, e.g. 8 fl. oz. or a 4 fl. oz. Some of the prior art bottles have removable bases in the open bottom end of the tubular body but most of these are usually a press fit in the body and not specifically designed to contact the bottom of the filled bag to provide it with any support.

It is an object of the present invention to provide a baby feeding bottle of the disposable bag liner type which is capable of receiving bags of differing capacities, the bottom of the filled bag being supported and in contact with a removable base inserted in the open bottom end of the rigid tubular body.

According to the invention therefore there is provided a baby feeding bottle of the disposable bag liner type comprising a hollow open ended rigid tubular body to receive a bag having an open top end which can be folded over the top rim of the tubular body, a feeding teat having an outwardly extending annular flange to engage and rest on the portion of the bag folded over the top rim of the tubular body, a teat retaining ring fitted to the tubular body to retain the teat and the folded over bag portion thereon and in sealing engagement therewith and a removable base mounted in the open bottom end of the rigid tubular body, the invention being characterised in that the removable base and tubular body include cooperating means which allow the base to be fixedly mounted in the tubular body in a plurality of different positions along the length thereof whereby the base is not movable from its selected position when an axial pressure is applied thereto and the base contacts and supports the bottom of a filled bag when in any one of said selected positions.

The base can be mounted in the tubular body in any convenient manner which allows its position therein to be changed thereby increasing or reducing the internal volume of the tubular body. For instance, the cooperating means can comprise cooperating screw threads on the base and body which allow the base to be screwed onto or into the body.

Alternatively the base can have laterally extending projections which locate in respective spaced apertures in the body. The spaced apertures can be discrete or connected by a slot along which the projections are guided as the base is moved from one selected position to another. The slot connecting the locating apertures or detents can be linear and aligned with the longitudinal axis of the body or helical with respect thereto.

Conveniently, the cooperating means comprises locating means which project from the base and are received in one or more positioning apertures formed in the body. In one embodiment, the positioning apertures comprise first and second sets of apertures located in the body at first and second spaced positions, the first position providing a first internal volume in the body and the second position providing a second internal volume less than said first volume, the filled bag resting, in use, on the base in either of said first or second positions, the first set of apertures being located adjacent the bottom open end of the body and the second set of apertures being spaced therefrom.

In a preferred embodiment, the removable base is reversible so that when it is in position in the hollow tubular body in one orientation, the bottom of a filled bag of a first capacity (e.g. 8 oz) rests on the base whereas when the base is reversed and inserted in the tubular body into its second position, the bottom of a filled bag of a second capacity (e.g. 4 oz) rests on the base. It should be noted that the bag capacities quoted are by way of example only. It will be appreciated therefore that the cooperating means on the base and body can be configured as required to suit bags of any chosen capacity.

The locating means provided on the reversible base are preferably positioned adjacent one end thereof to be received in the positioning apertures in the body when the base is mounted therein in said first position whereas when the base is reversed, said locating means are received in the same positioning apertures but the base is mounted in the body in said second position.

In a preferred embodiment, the base is cup-shaped and includes two diametrically opposed cut out portions in the side walls thereof to provide a pair of facing upstanding wings. Conveniently the locating means are provided on said wings. The base can however be generally disc shaped.

In the preferred embodiment, the positioning apertures are diametrically opposed to each other on the tubular body, an open ended guide-way or slot extending from the bottom of the tubular body to each positioning aperture or detent. Preferably, each positioning aperture is wider than the guideway to provide a T-shaped cut-out in the side wall of the rigid tubular body adjacent the open bottom end thereof.

Suitably each locating means comprises a laterally extending projection or lug having a first part of a width no greater than the width of the guide-way and a second wider part of a width substantially equal to or slightly less than the width of the positioning aperture, whereby when the base is inserted in the open end of the tubular body by locating the first part of the projecting means in its respective guide-way, it can then be slid along said guide-way until the second part locates in the wider positioning aperture to fix the base in position in the tubular body.

In a preferred embodiment, each wing of the base is resiliently flexible so that the locating means thereon can be flexed towards each other to facilitate fitting and removal of the base in the tubular body. In use, each locating means springs outwardly to engage in its respective positioning aperture where it is aligned therewith during fitting, the wings requiring to be flexed towards each other to disengage the locating means from their respective positioning apertures to allow the base to be removed from the tubular body.

Conveniently the base and body are molded from a rigid plastics material.

Preferably the base has a central aperture formed therein to permit a user of the bottle to dispel air from the filled bag contained within the rigid tubular body by poking it with his or her finger through said hole.

A preferred embodiment of the invention will now be described, by way of example only, with reference to the accompanying drawings, in which.

Figure 1:
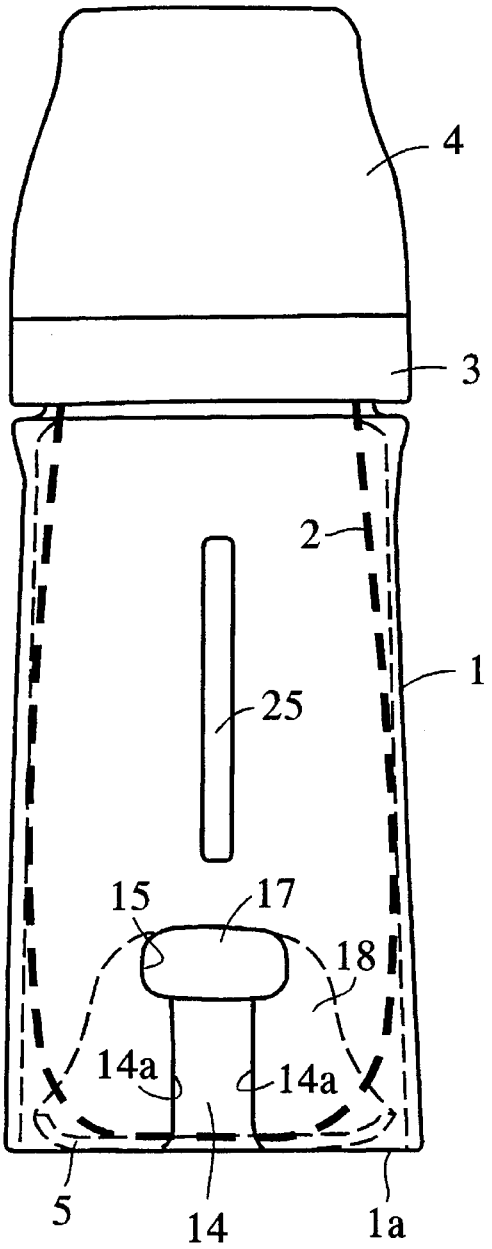
FIG. 1 is a side view of a baby feeding bottle of the present invention showing the liner bag and removable base in dotted lines.
Figure 2:
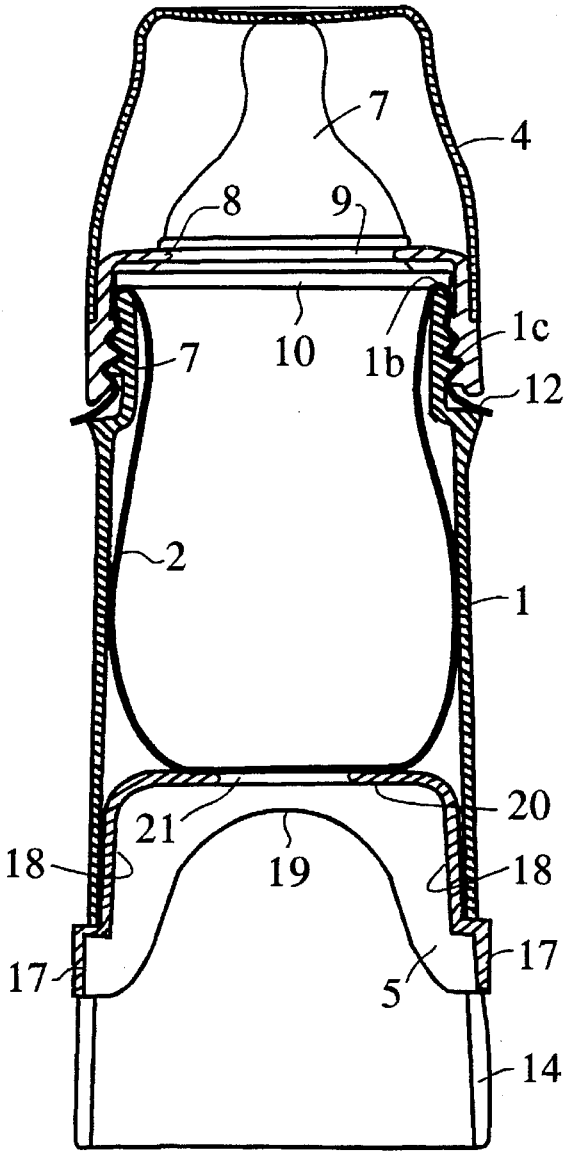
FIG. 2 is a cross section through the bottle shown in FIG. 1 but rotated through 90°.

Referring now to the drawings, FIGS. 1 and 2 show a baby feeding bottle of the present invention to comprise a hollow tubular rigid body 1 having an open bottom end 1*a* and an open upper end 1*b* with screw threads 1*c* formed thereon. A flexible bag liner 2 is mounted in the tubular body 1 with its upper open end folded over the threads 1*c* and retained thereon by means of the teat retaining ring 3 and teat 7 which has an outwardly extending annular flange at its base and an annular recess 9 adjacent thereto which receives the rim of a central hole 8 formed in the teat retaining ring 3 (see FIG. 2). The ring 3 is formed with internal screw threads 1*d* which cooperate with the threads 1*c* on the body to allow the ring 3 to be screwed onto the body. A dormal cap 4 is fitted onto the retaining ring 3 to protect the teat 7 and the open end of the hollow tubular body 1 is closed by a removable base 5. An elongate slot 25 is formed in the body 1 on one or both sides thereof to provide a visual indication of the contents of the liner bag 2 therein.

Each side of the bottom of the tubular body 1 is formed with an elongate guide-way 14 which opens up into an enlarged positioning aperture 15. The guide-way 14 and positioning aperture 15 together provide a generally T-shaped cut-out in the base of the tubular body 1 for reasons which will be explained hereafter.

Figure 3:
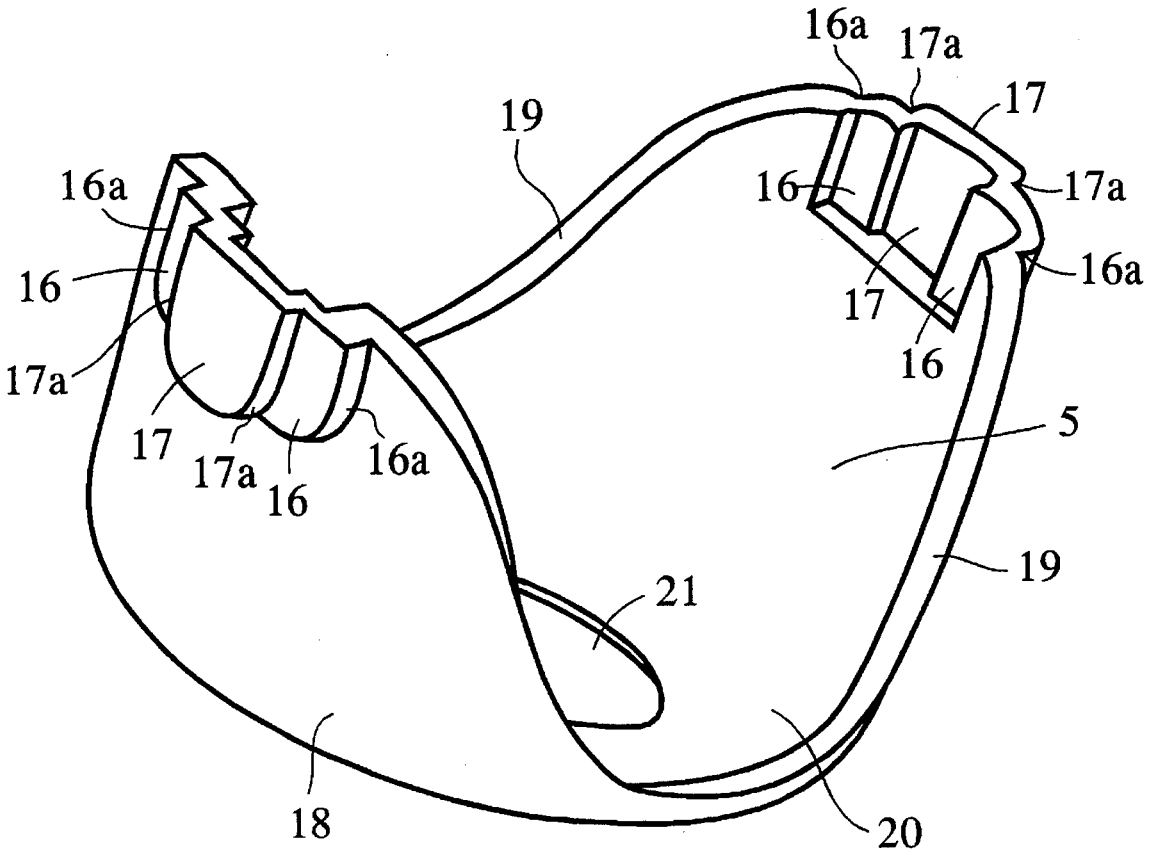
FIG. 3 is a perspective view of the removable base illustrated in FIGS. 1 and 2.

Referring now to FIG. 3, it can be seen that the base 5 is generally cup-shaped and includes cut-out side portions 19 to provide diametrically opposed upstanding side flanges or wings 18. The upper end of each wing 18 is formed with locating means in the form of a first locating lug 16 and a second locating lug 17. The first locating lug 16 has side edges 16*a*. The second locating lug 17 is narrower than the first locating lug 16 and has side edges 17*a*. The base 5 also includes a bottom wall 20 in which a central aperture 21 is formed. It should be noted that the distance between the outside faces of the diametrically opposed first locating lugs 16 is slightly greater than the internal diameter of the open end 1*a* of the tubular body 1 for reasons to be explained hereafter.

In order to insert the base 5 in the open end 1*a* of the tubular body 1, the base 5 is offered up to it and the two upstanding wings 18 are flexed inwardly towards each other so that first lugs 16 are fitted into the interior of the tubular body and the second locating lugs 17 are located in their respective guideways 14, their side edges 17*a* being in contact with the sides 14*a* of the guideway 14. The base 5 is then pushed up the tubular body 1 and the lugs 17 slide along the guideways 14 until the first locating lugs 16 are fully received in their respective positioning apertures 15. When this happens, the wings 18 are able to spring outwardly due to their built in resilience and the first locating lugs 16 position themselves wholly within the openings 15 as shown in FIG. 2 to retain the base 5 in a fixed position relative thereto.

The removable base 5 is shown in FIG. 1 in its first position in which the bottom wall 20 is generally coterminous with the open end 1*a* of the tubular body 1 whereas in FIG. 2, the base 5 is reversed and the base 20 is located intermediate the ends 1*a* and 1*b* of the tubular body 1. In both positions, it will be noted that the bottom of the filled bag 2 rests on the bottom wall 20 of the base and is fully supported thereby so the risk of the liner bag rupturing due to movement during shaking to mix the contents of the liner bag is substantially reduced.

The removable base is preferably molded from a resilient rigid plastics material and shaped to permit the locating means thereon to be flexed inwardly towards each other to facilitate fitting and removal of the base from the tubular body 1. The base can be fitted in the base in any convenient way, e.g. using a bayonet or screw fit.

The main advantage of the bottle of the present invention over the prior art are that the design of the removable base means that there is no need to provide different bases for use with different bag capacities. A single base is used for 4 oz and 8 oz bags so there are substantial savings in tooling costs, material costs and stock keeping units.

Furthermore, because the removable base supports the filled bag liner at all times, accidental opening or spilling out from the liner bag is much less likely than with known prior art bottles. The bottle of the present invention is therefore much safer and more convenient to use and it also allows much easier mixing of the powdered formula feed in the bottle as mixing can either be done by shaking the complete assembly or by stirring the contents of the liner bag with the teat and retaining ring removed, this being possible because the bottom of the bag is supported by the base at all times.

We claim:

1. A baby feeding bottle of the disposable bag liner type comprising a hollow open ended rigid tubular body to receive a bag having an open top end which can be folded over the top rim of the tubular body, a feeding teat having an outwardly extending annular flange to engage and rest on the portion of the bag folded over the top rim of the tubular body, a teat retaining ring fitted to the tubular body to retain the teat and the folded over bag portion thereon and in sealing engagement therewith and a removable base mounted in the open bottom end of the rigid tubular body, the removable base having locating means thereon for engaging with receiving means in the tubular body for fixedly mounting the base in the tubular body in different positions along the length thereof, the base being retained in its selected position and axially immovable therefrom when an axial pressure is applied to said base, the base contacting and supporting the bottom of a filled bag when in said selected position, wherein the removable base is reversible so that when it is in position in the hollow tubular body in a first position in a first orientation, the bottom of a filled bag of a first capacity rests on the base whereas when the base is reversed and inserted in the tubular body into a second position in a second orientation, the bottom of a filled bag of a second capacity rests on the base.

2. A baby feeding bottle of the disposable bag liner type comprising a hollow open ended rigid tubular body to receive a bag having an open top end which can be folded over the top rim of the tubular body, a feeding teat having an outwardly extending annular flange to engage and rest on the portion of the bag folded over the top rim of the tubular body, a teat retaining ring fitted to the tubular body to retain the teat and the folded over bag portion thereon and in sealing engagement therewith and a removable base mounted in the open bottom end of the rigid tubular body, the removable base having locating means thereon for engaging with receiving means in the tubular body for fixedly mounting the base in the tubular body in different positions along the length thereof, the base being retained in its selected position and axially immovable therefrom when an axial pressure is applied to said base, the base contacting and supporting the bottom of a filled bag when in said selected position, wherein the locating means comprise projections which extend laterally from the base, the receiving means comprising positioning apertures formed in the body and the positioning apertures are diametrically opposed to each other in the tubular body and an open ended guide-way extends from the bottom of the tubular body to each of said positioning apertures.

3. A bottle as claimed in claim 2 wherein each positioning aperture is wider than the guideway to provide a T-shaped cut-out in the side wall of the rigid tubular body adjacent the open bottom end thereof.

4. A baby feeding bottle of the disposable bag liner type comprising a hollow open ended rigid tubular body to receive a bag having an open top end which can be folded over the top rim of the tubular body, a feeding teat having an outwardly extending annular flange to engage and rest on the portion of the bag folded over the top rim of the tubular body, a teat retaining ring fitted to the tubular body to retain the teat and the folded over bag portion thereon and in sealing engagement therewith and a removable base mounted in the open bottom end of the rigid tubular body, the removable base having locating means thereon for engaging with receiving means in the tubular body for fixedly mounting the base in the tubular body in different positions along the length thereof, the base being retained in its selected position and axially immovable therefrom when an axial pressure is applied to said base, the base contacting and supporting the bottom of a filled bag when in said selected position, wherein the locating means comprise projections which extend laterally from the base, the receiving means comprising positioning apertures formed in the body wherein the locating projections are formed on the base diametrically opposite each other, each projection having a first part of a width no greater than the width of the guide-way and a second part of a greater width substantially equal to the width of the positioning aperture, whereby when the base is inserted in the open end of the tubular body by locating the first part of each locating projection in its respective guide-way, the projection is configured for sliding along said guide-way until the second part thereof locates in the wider positioning aperture to fix the base in position in the tubular body.

* * * * *